US009321162B2

(12) United States Patent
Adachi et al.

(10) Patent No.: US 9,321,162 B2
(45) Date of Patent: Apr. 26, 2016

(54) ELECTRIC DRIVING TOOL HAVING DRIVE MECHANISM CONTROLLER

(75) Inventors: Michiaki Adachi, Chuo-ku (JP); Kouji Kubo, Chuo-ku (JP); Yoshihiko Kondou, Chuo-ku (JP); Yuuji Yamaguchi, Chuo-ku (JP)

(73) Assignee: MAX CO., LTD., Tokyo (JP)

( * ) Notice: Subject to any disclaimer, the term of this patent is extended or adjusted under 35 U.S.C. 154(b) by 555 days.

(21) Appl. No.: 13/495,340

(22) Filed: Jun. 13, 2012

(65) Prior Publication Data

US 2012/0325886 A1 Dec. 27, 2012

(30) Foreign Application Priority Data

Jun. 24, 2011 (JP) ..... 2011-140590

(51) Int. Cl.
*B25C 1/06* (2006.01)
*B25C 1/00* (2006.01)

(52) U.S. Cl.
CPC .. *B25C 1/06* (2013.01); *B25C 1/008* (2013.01)

(58) Field of Classification Search
CPC ..... B25C 1/008; B25C 1/06; B25C 5/1665; B25C 5/1689
USPC ..... 227/2, 3, 110, 119–121, 125, 129, 156, 227/7, 8, 134, 314
See application file for complete search history.

(56) References Cited

U.S. PATENT DOCUMENTS

| | | | | |
|---|---|---|---|---|
| 2,973,519 | A * | 3/1961 | Jopp | 227/128 |
| 4,807,793 | A | 2/1989 | Ghibely | |
| 4,834,278 | A | 5/1989 | Lin | |
| 5,720,423 | A | 2/1998 | Kondo et al. | |
| 6,955,281 | B1 * | 10/2005 | Wei | 227/2 |
| 1,308,118 | A1 | 2/2006 | Hu | |
| 1,849,202 | A1 | 10/2009 | Adachi | |
| 2008/0011806 | A1 | 1/2008 | Kitagawa | |
| 2008/0110652 | A1 * | 5/2008 | Wen | 173/1 |
| 2009/0179062 | A1 * | 7/2009 | Shima et al. | 227/2 |
| 2009/0255972 | A1 * | 10/2009 | Shima et al. | 227/2 |
| 2010/0219226 | A1 * | 9/2010 | Akiba | 227/8 |

FOREIGN PATENT DOCUMENTS

| | | | |
|---|---|---|---|
| CN | 1704207 | A | 12/2005 |
| CN | 1849202 | A | 10/2006 |
| CN | 1308118 | C | 4/2007 |
| JP | 62-81581 | | 5/1987 |
| JP | 2-44675 | | 10/1990 |
| JP | H09-295283 | A | 11/1997 |
| JP | 3344454 | | 11/2002 |
| JP | 2006-026858 | A | 2/2006 |
| JP | 2009-006445 | A | 1/2009 |
| JP | A-2011-56613 | | 3/2011 |

OTHER PUBLICATIONS

Office Action issued Feb. 27, 2015 in European Patent Application No. 12004488.8.

* cited by examiner

*Primary Examiner* — Stephen F Gerrity
*Assistant Examiner* — Joshua Kotis
(74) *Attorney, Agent, or Firm* — Drinker Biddle & Reath LLP

(57) ABSTRACT

In an electric driving tool of the invention, when moving a driver 21 having driven out a fastener upwardly from a bottom dead center position and making the driver 21 to stop at a wait position, a wait position when a decrease of a residual quantity of connected fasteners in the magazine 12 is detected is set to be lower than a wait position when the decrease of a residual quantity of connected fasteners in the magazine 12 is not detected.

6 Claims, 10 Drawing Sheets

ELECTRIC DRIVING TOOL HAVING DRIVE MECHANISM CONTROLLER

BACKGROUND OF THE INVENTION

1. Field of the Invention

The invention relates to an electric driving tool.

2. Related Art

There is known an electric driving tool which includes a plunger normally energized downwardly by a spring and a driver fixed to this plunger, and in which the plunger is released after it is pushed up and the driver is driven by an energizing force of the spring to drive a fastener.

In this electric driving tool, the driver waits at a given wait position when not driven.

Patent Reference 1: JP-B-02-044675

Patent Reference 2: U.S. Pat. No. 4,807,793

Patent Reference 3: JP-U-62-081581

Patent Reference 4: JP-B2-3344454

For example, in tools disclosed in Patent Reference 1 and Patent Reference 2, a driver waits at a bottom dead center position.

In a tool disclosed in Patent Reference 3, a driver waits at a top dead center position.

In a tool disclosed in Patent Reference 4, a driver waits near a top dead center position.

According to the tools of Patent Reference 1 and 2, since the driver is structured to wait at the bottom dead center position, there is found a problem that, in a driving time, the driver must be moved to the top dead center, which worsens the tool's response from a trigger operation to a driving operation.

According to the tools of Patent Reference 3, since a plunger and the driver are structured to wait at the top dead center position, when a motor rotates with poor precision, there is a possibility that, although the motor must be so rotated as to stop the driver at the top dead center position, it can be rotated in error to move the driver to its driving position. This raises a danger that the driver can drive the fastener in error. When the driver's waiting state is removed due to such unexpected malfunction, the driving operation is carried out instantaneously. Therefore, a mechanical preventive mechanism or the like is necessary.

According to the tool of Patent Reference 4, since the driver is structured to wait near the top dead center, the response time problem does not arise and, and since the driver stays downward of its driving portion, there is not a danger that the driver may drive a fastener in error.

However, according to the tool in which the driver is structured to wait near the top dead center position such as the tool of Patent Reference 4, the driver only contacts with a portion of the connected fasters near heads thereof. Therefore, when the residual quantity of the connected fasteners becomes small, there is a possibility that only leading end portions of the connected fasters not in contact with the driver may be pushed forward and thus these connected fasteners may be inclined obliquely within a magazine (see FIG. 11). If new connected fasteners are additionally loaded into the magazine while the connected fasteners are still inclined obliquely within the magazine, there is a possibility that the head of the last one of the obliquely inclined connected fasteners can be superimposed on the head of a leading one of the added connected fasteners, whereby a fastener storing portion cannot be closed.

This problem can be solved by increasing a guide margin of a guide member for holding the leading end portions of the fasteners within the magazine. That is, if the guide margin of the guide member is increased, although there is a possibility that the connected fasteners, the residual quantity of which has decreased, is inclined obliquely within the magazine; even in this case, the obliquely inclined connected fasteners and the added connected fasteners can be prevented from being superimposed on each other.

However, with such increased guide margin, a space necessary for loading the connected fasteners into the guide member or taking out them therefrom is increased. That is, when the connected fasteners are loaded into or removed from the guide member, the connected fasteners must be moved in an axial direction more greatly than the guide margin, which makes it necessary to increase a clearance for moving the fasteners in such axial direction.

Thus, when the response performance and safety are taken into account, the driver may preferably be made to wait at an intermediate position between the top and bottom dead centers. However, when the driver is made to wait at the intermediate position between the top and bottom dead centers, there is a problem that the connected fasteners, the quantity of which is decreased, may be inclined obliquely within the magazine. To solve this problem, the guide margin of the guide member may be increased. But, this raises a problem that the size and weight of the whole driving tool are increased.

SUMMARY OF THE INVENTION

An embodiment of the invention relates to an electric driving tool which can maintain its response performance and safety and also can prevent connected fasteners from inclining obliquely within a magazine without increasing a guide margin of a guide member.

DETAILED DESCRIPTION OF THE EMBODIMENTS

Description will be given below of an embodiment of the invention with reference to the accompanying drawings.

Figure 1:
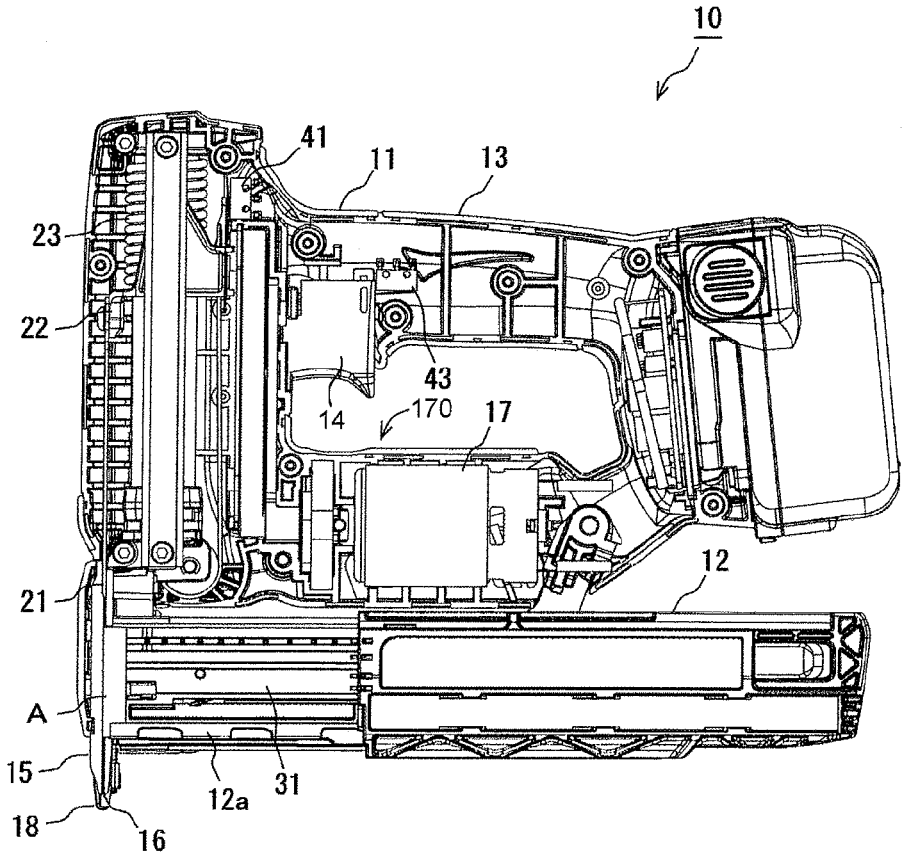
FIG. 1 is a section view of an electric driving tool of an embodiment, with a driver existing at a top dead center position.

An electronic driving tool 10 of the embodiment is a spring drive type electric driving tool which is driven by a spring force and is structured to drive out fasteners. The driving tool 10, as shown in FIG. 1, includes, within a housing 11, a plunger 22 normally energized downwardly by a spring 23 constituting an energizing mechanism, a driver 21 fixed to the plunger 22, a drive mechanism 170 which pushes up and then releases the plunger 22 to thereby drive the driver 21 using an energizing force of the spring 23.

In a lower portion of the housing 11, there is disposed a magazine 12 in which connected fasteners A to be driven out by the driver 21 are accommodated. A pusher 31 disposed within the magazine 12 is used to sequentially supply leading ones of the connected fasteners A in the magazine 12 toward the driver 21.

A nose portion 15 is provided at a front end side of the magazine 12. The leading one of the connected fasteners A in the magazine 12 is supplied to the nose portion 15 by the pusher 31. That is, since the pusher 31 is normally energized by a spring (not shown) toward the nose portion 15, the connected fasteners A are pressed toward the nose portion 15 by this energizing force, whereby, whenever the leading faster is driven, a next leading faster can be supplied to the nose portion 15.

The leading fastener supplied to the nose portion 15 is driven by the driver 21 from an injection port 16 formed in the leading end of the nose portion 15. Since the driver 21 of the embodiment is fixed to the plunger 22, when the plunger 22 is operated, the driver 21 slides toward the injection port 16 to thereby drive out a fastener supplied to the nose portion 15 from the injection port 16.

The plunger 22 is disposed within the housing 11 and is slidable vertically along the fastener injection direction. The plunger 22 includes, in its side portion an engaging portion (not shown) to be engaged with the drive mechanism 170.

The drive mechanism 170 for pushing up the plunger 22 against the energizing force of the spring 23 includes multiple gears (not shown) for pushing up the plunger 22 and a motor 17 for rotating the gears.

When a trigger 14 serving as an operation mechanism is operated, the drive mechanism 170 starts to operate. Specifically, when a control unit 100 (to be discussed later) receives an operation signal of the trigger 14, the control unit 100 starts an operation of the motor 17. When the motor 17 starts its operation, the multiple gears connected to a drive shaft of the motor 17 are rotated. When rotated, the gears push up the plunger 22. As the gears are rotated further, when the plunger 22 and driver 21 reach a top dead center, an engagement between the gears and plunger 22 is removed to release the plunger 22, whereby the driver 21 is driven downwardly by the energizing force of the spring 23 to execute an injection processing.

That is, as the trigger 14 is pulled, the drive mechanism 170 operates to rotate the gears, thereby pushing up the plunger 22 engaged with the gears. Since the engagement between the gears and plunger 22 is removed when the plunger 22 and driver 21 reach the top dead center, the plunger 22 is moved by the energizing force of the spring 23 and the driver 21 connected to the plunger 22 slides toward the injection port 16 to drive out the fasteners.

Figure 2:
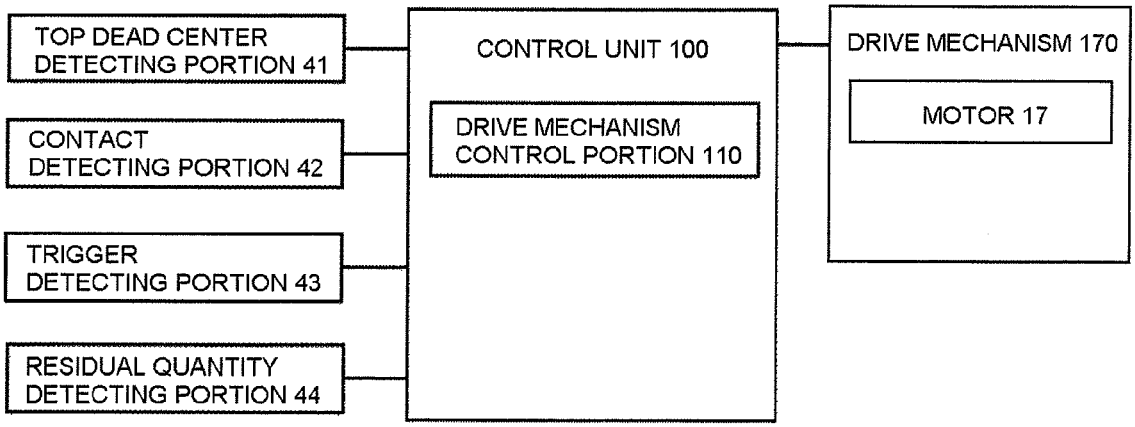
FIG. 2 is a block diagram of an inputs and outputs of the electric driving tool of the embodiment.

Here, as shown in FIG. 2, within the driving tool 10, there is provided the control unit 100 including a CPU, a RAM and the like, while this control unit 100 controls the driving of the motor 17 according to an input signal from the trigger 14 or a micro switch. The control unit 100 controls various input devices and output devices by the CPU reading programs stored in the ROM.

(Input Device)

The control unit 100 includes, as its input devices, as shown in FIG. 2, a top dead center detecting portion 41, a contact detecting portion 42, a trigger detecting portion 43 and a residual quantity detecting portion 44. Here, the input devices shown in FIG. 2 are not limitative but other input devices may also be employed.

(Top Dead Center Detecting Portion 41)

The top dead center detecting portion 41 is used to detect that the plunger 22 and driver 21 reach the top dead center position and, specifically, as shown in FIG. 1, it is a top dead center detecting switch to be depressed by the plunger 22. The top dead center detecting portion 41, when the plunger 22 having moved to the top dead center position depresses the switch, outputs a top dead center detecting signal to the control unit 100.

(Contact Detecting Portion 42)

The contact detecting portion 42 is used to detect that the leading end of the nose portion 15 is pressed against a driven member and, specifically, it is a contact detecting switch to be depressed by a contact arm 18. The contact detecting portion 42, when the contact arm 18 is pressed against the driven member to depress the switch, outputs a contact detecting signal to the control unit 100. On receiving the contact detecting signal, the control unit 100 detects that driving preparation has been completed.

Here, the contact arm 18 is a member which is energized downwardly in the leading end of the nose portion 15 and is slidable upwardly. Therefore, when the contact arm 18 is pressed against the driven member, it slides upwardly to depress the contact detecting switch. When the contact detecting switch is depressed, the contact detecting portion 42 outputs a contact detecting signal to the control unit 100. Since the control unit 100 drives the driver 21 only when it receives the contact detecting signal (when the driving preparation is completed), the fasteners can be driven safely.

(Trigger Detecting Portion 43)

The trigger detecting portion 43 is used to detect the operation of the trigger 14 and, specifically, as shown in FIG. 1, it is a trigger detecting switch disposed upwardly of the trigger 14. The trigger detecting portion 43, when the trigger 14 is operated to depress the switch, outputs a trigger detecting signal to the control unit 100.

(Residual Quantity Detecting Portion 44)

Figure 6:
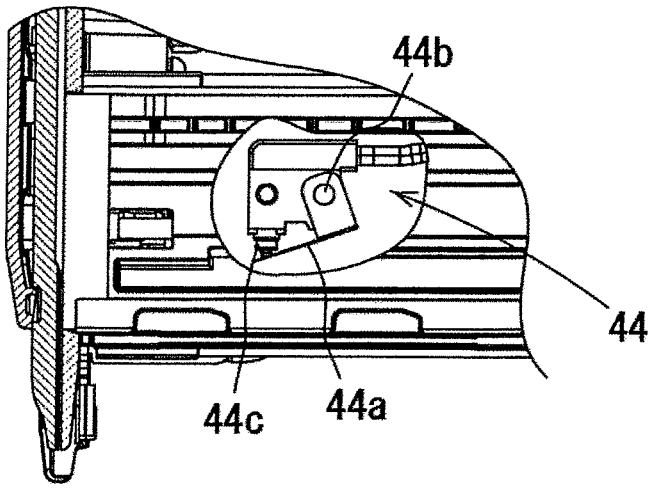
FIG. 6 is an explanatory view of the residual quantity detecting portion of the electric driving tool of the embodiment.

The residual quantity detecting portion 44 is used to detect that the residual quantity of the connected fasteners A loaded in the magazine 12 has decreased and, specifically, as shown in FIG. 6, it is a residual quantity detecting switch disposed within the magazine 12. This portion 44 is fixed to the magazine 12.

Figure 7A:
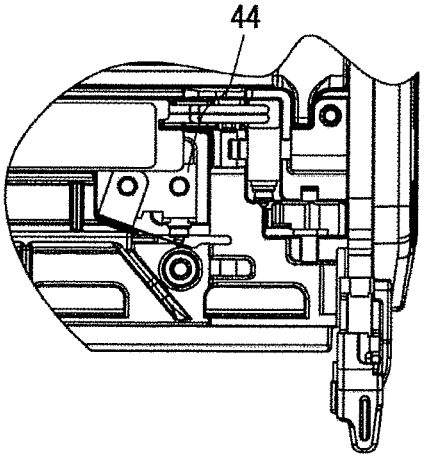
FIGS. 7A and 7B are explanatory views of the electric driving tool of the embodiment, showing how the residual quantity detecting portion operates.
Figure 7B:
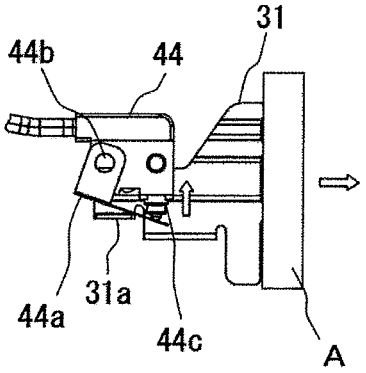

In this residual quantity detecting portion 44, as shown in FIGS. 7A and 7B, when the pusher 31 is moved toward the nose portion 15 due to the decreased residual quantity of the connected fasteners A loaded in the magazine 12, an oscillatory member 44*a* pivotally supported by the oscillation shaft 44*b* of the residual quantity detecting portion 44 is oscillated by a contact piece 31*a* provided on the pusher 31, thereby depressing a switch for a button 44*c*. Therefore, when the residual quantity of the connected fasteners A loaded in the magazine 12 has decreased to a predetermined quantity, the contact piece 31*a* depresses the switch, thereby being able to detect that the residual quantity of the connected fasteners A has decreased to a given quantity.

The residual quantity detecting portion 44, when detecting that the residual quantity of the connected fasteners A has decreased, outputs a residual quantity detecting signal to the control unit 100.

(Control Unit 100)

Next, description will be given below specifically of the control unit 100.

The control unit 100 is used to control the various devices of the electric driving tool 10 and functions as a drive mechanism control portion 110.

Here, the control unit 100 is not limited to the drive mechanism control portion 110 but may also include other means.

(Drive Mechanism Control Portion 110)

The drive mechanism control portion 110 is a program for controlling the operation of the drive mechanism 170. The drive mechanism control portion 110 controls the operation of the drive mechanism 170 by controlling the number of rotations of the motor 17.

Specifically, while a contact detecting signal is being output from the contact detecting portion 42 because the contact arm 18 is pressed against the driven member, when the trigger 14 is operated and a trigger detecting signal is output from the trigger detection portion 43, the drive mechanism control portion 110 starts the driving of the motor 17. As described above, when the motor 17 is driven, the plunger 22 is pushed up to the top dead center position and is then released, whereby the driver 21 is driven down to the bottom dead center to inject a fastener.

After then, by continuing the driving of the motor 17 further, the driver 21 having driven out the fastener is controlled to move upwardly from the bottom dead center position and stop at a given wait position.

Figure 3:
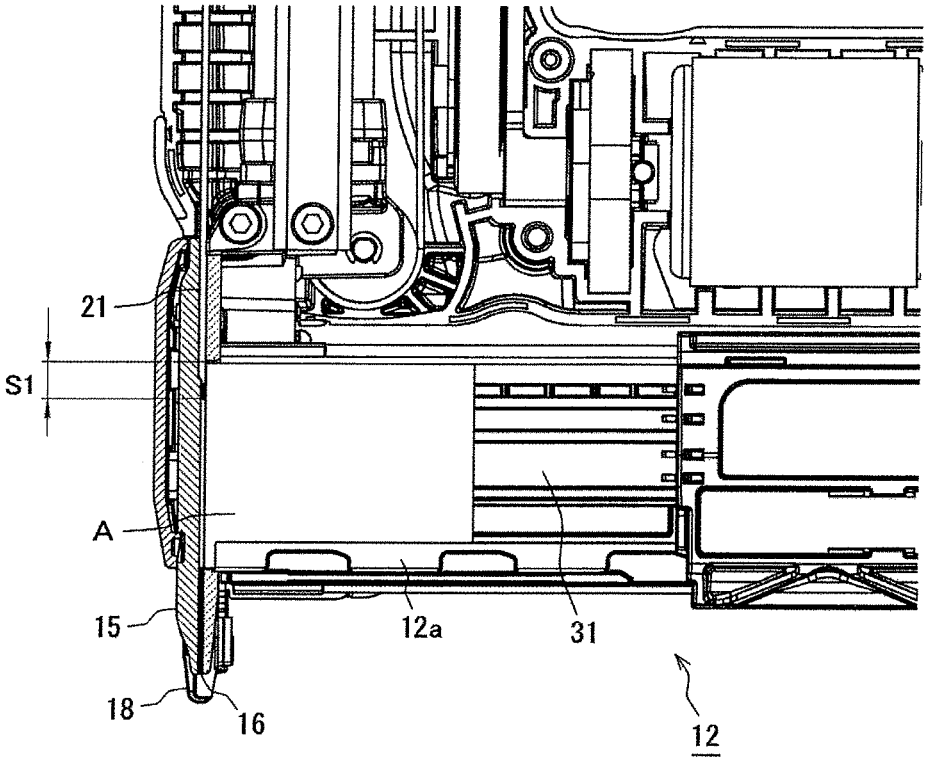
FIG. 3 is a partially enlarged section view of the electric driving tool of the embodiment, with the driver existing at a first wait position.

In this case, depending on whether a residual quantity detecting signal is output from the residual quantity detecting portion 44 or not, the wait positions of the plunger 22 and driver 21 are changed. That is, when the decreased residual quantity of the connected fasteners A loaded in the magazine 12 is not detected, as shown in FIG. 3, the plunger 22 and driver 21 are caused to wait at their first wait position. On the other hand, when detected, as shown in FIG. 4, the plunger 22 and driver 21 are caused to wait at their second wait positions which are set downwardly of the first wait positions.

The first wait position, as shown in FIG. 3, is a position where the plunger 22 and driver 21 wait near the top dead center position, while the leading end of the driver 21 is caused to wait upwardly of the middle position of the connected fasteners A loaded in the magazine 12. Further specifically, the distance from the driver 21 leading end to the fastener A head is equal to or less than ¼ of the whole length of the connected fasteners A.

Figure 4:
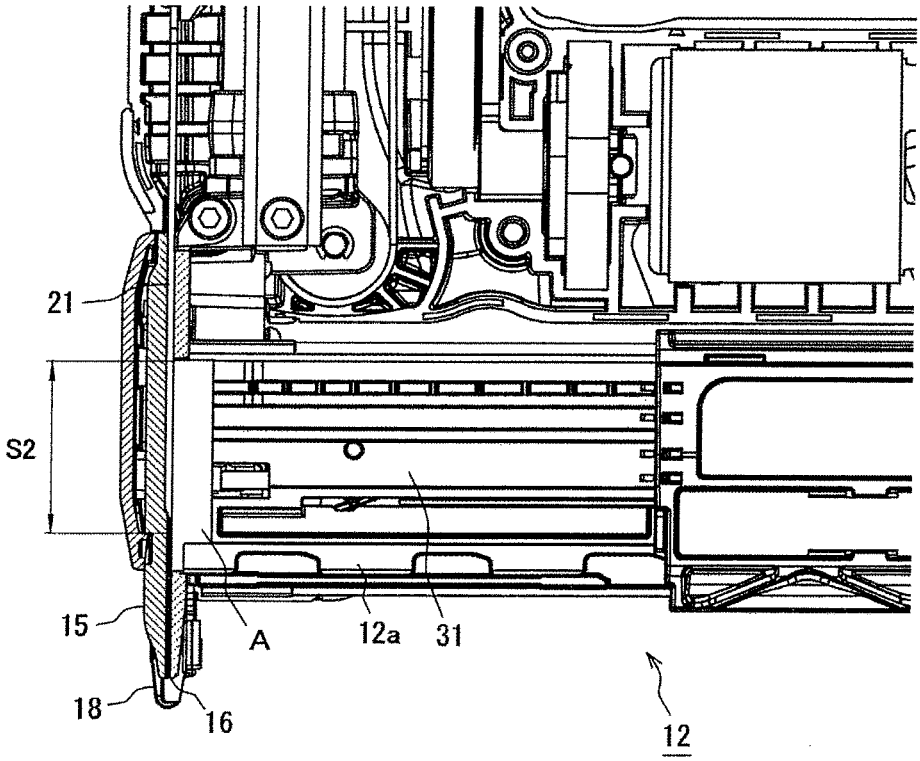
FIG. 4 is a partially enlarged section view of the electric driving tool of the embodiment, with the driver existing at a second wait position.
Figure 5:
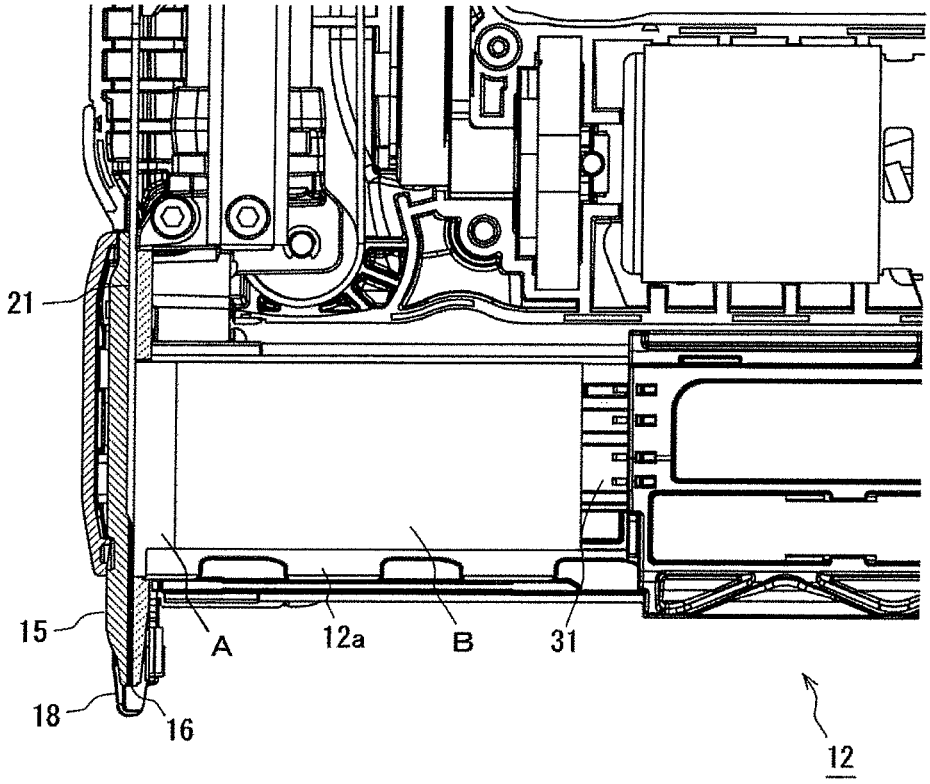
FIG. 5 is a partially enlarged section view of the electric driving tool of the embodiment, with new connected fasteners added.

The second wait position, as shown in FIG. 4, is a position where the plunger 22 and driver 21 wait near the bottom dead center position, while the leading end of the driver 21 is caused to wait downwardly of the middle position of the connected fasteners A loaded in the magazine 12. Further specifically, the distance from the driver 21 leading end to the fastener A head is equal to or more than ¾ of the whole length of the connected fasteners A.

Therefore, as shown in FIGS. 3 and 4, the distance S1 from the driver leading end to the fastener head at the first wait position is shorter than the distance S2 from the driver leading end to the fastener head at the second wait position.

(Processings of Drive Mechanism Control Portion 110)

Next, description will be given below of a flow of processings to be executed by the drive mechanism control portion 110 of the embodiment.

(Main Processing)

Figure 8:
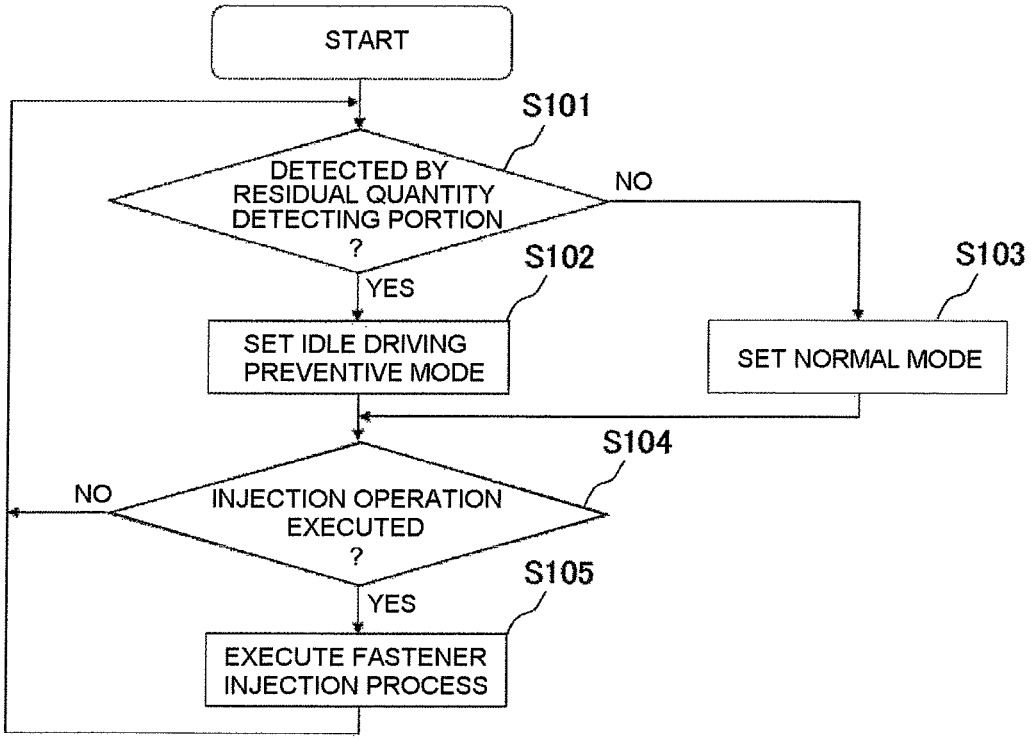
FIG. 8 is a flow chart of a main processing to be executed in the embodiment.

FIG. 8 is a flow chart of the main processing of the drive mechanism control portion 110.

Firstly, in Step S101 shown in FIG. 8, the drive mechanism control portion 110 checks whether a residual quantity detecting signal is output from the residual quantity detecting portion 44 or not. When output, the processing advances to Step S102. When not, it advances to Step S103.

In Step S102, an idle drive preventive mode is set (for example, an internal flag expressing the idle drive preventive mode is set for ON). And, the processing advances to Step S104.

In Step S103, a normal mode is set (for example, the internal flag expressing the idle drive preventive mode is set for OFF). And, the processing advances to Step S104.

In Step S104, it is checked whether a contact detecting signal is output from the contact detecting portion 42 and a trigger detecting signal is output from the trigger detecting portion 43 or not. When both signals are output, the processing advances to Step S105, where a fastener injection processing is executed. When neither is output, the processing goes back to Step S101.

(Fastener Injection Processing)

Figure 9:
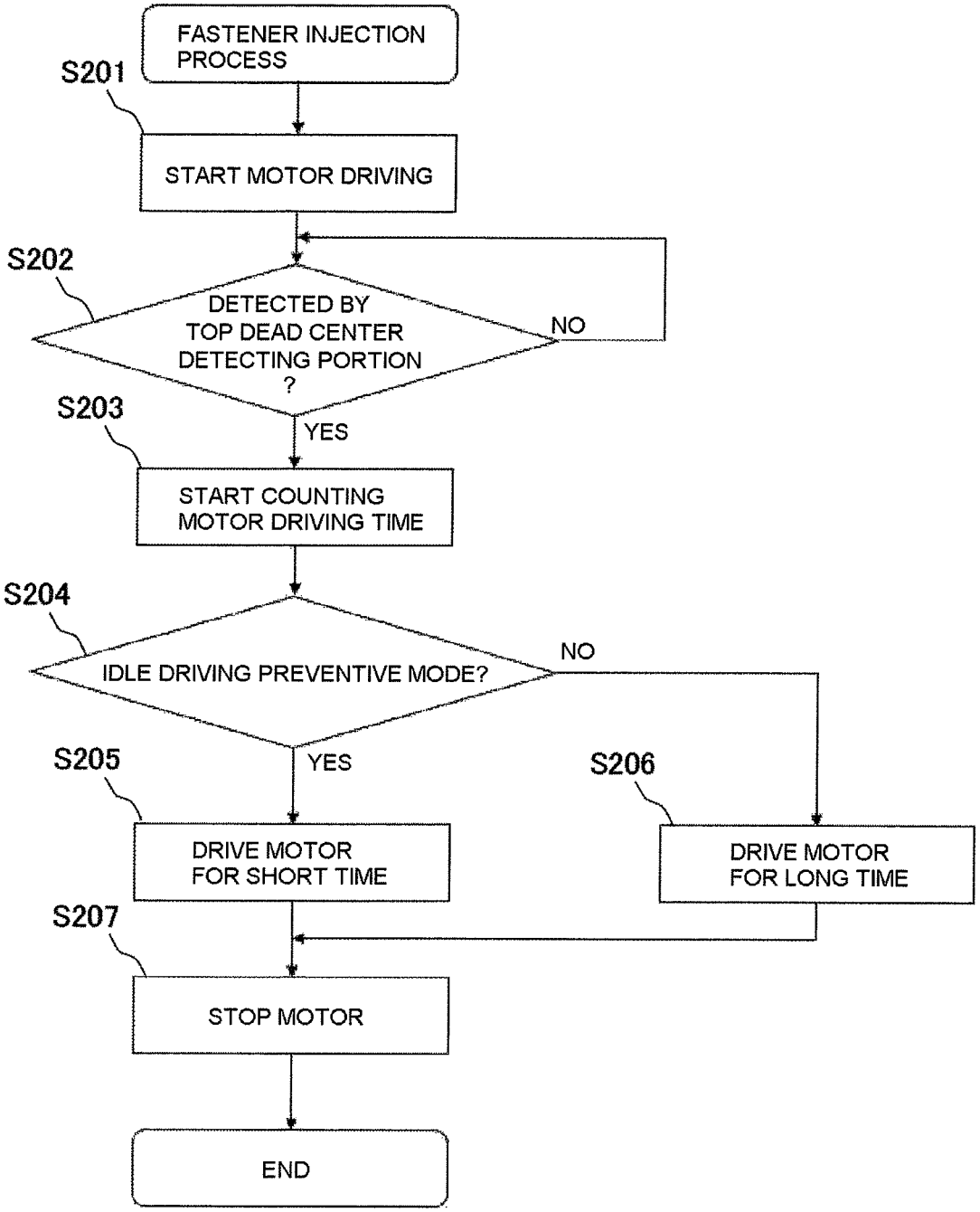
FIG. 9 is a flow chart of a fastener injection processing to be executed in the embodiment.

FIG. 9 is a flow chart of the fastener injection processing of the drive mechanism control portion 110.

Firstly, in Step S201 shown in FIG. 9, the drive mechanism control portion 110 starts to drive the motor 17, whereby the drive mechanism 170 starts its operation. And, the processing advances to Step S202.

In Step S202, the processing waits until a top dead center detecting signal is output from the top dead center detecting portion 41. When output, the processing advances to Step S203. Here, immediately after the top dead center detecting signal is output from the top dead center detecting portion 41, the engagement between the plunger 22 and the gears of the drive mechanism 170 is removed, whereby the fastener is injected by the driver 21.

In Step S203, the drive mechanism control portion 110 starts to count the drive time of the motor 17 using a software counter. Then, the processing advances to Step S204.

In Step S204, it is checked whether a current mode is the idle driving preventive mode or not (for example, an internal flag expressing the idle driving preventive mode is on or not). When yes, the processing advances to Step S205. When no (that is, when it is a normal mode), the processing advances to Step S206.

In Step S205, the motor 17 is driven until the count of the drive time of the motor 17 by the software counter reaches a predetermined drive time for the idle driving preventive mode. And, when the predetermined drive time for the idle driving preventive mode has passed, the processing advances to Step S207, where the driving of the motor 17 is stopped to thereby end the processing.

In Step S206, the motor 17 is driven until the count of the drive time of the motor 17 by the software counter reaches a predetermined drive time for a normal mode. And, when the predetermined drive time for a normal mode has passed, the processing advances to Step S207, where the driving of the motor 17 is stopped to thereby end the processing.

Here, the drive time for the idle driving preventive mode is set shorter than the drive time for a normal mode. Thus, when the motor 17 is stopped after it is driven up to the drive time for a normal mode, the driver 21 and plunger 22 stop at the first stand-by position shown in FIG. 3. Also, when the motor 17 is stopped after it is driven up to the drive time for the idle driving preventive mode, the driver 21 and plunger 22 stop at the second stand-by position shown in FIG. 4.

In the embodiment, the electric driving tool may include the plunger 22 normally energized downward by the energizing mechanism 23, the driver 21 fixed to the plunger 22, the drive mechanism 170 for pushing up and then releasing the plunger 22 to thereby drive the driver 21 using the energizing force of the energizing mechanism 23, the operation mechanism 14 for operating the drive mechanism 170, the magazine 12 with the connected fasteners loaded therein, the pusher 31 for sequentially supplying the leading ones of the connected fasteners loaded in the magazine 12 to the nose portion 15, the residual quantity detecting portion 44 for detecting the decreased residual quantity of the connected fasteners loaded in the magazine 12, and the drive mechanism control portion 110 for controlling the operation of the drive mechanism 170. The drive mechanism control portion 110, when the operation mechanism 14 is operated, controls the driver 21 having driven out the fastener to move upwardly from the bottom dead center position and stop at a given wait position. When it detects the decreased residual quantity of the connected fasteners loaded in the magazine 12, a given wait position may be set lower than one before detected.

In this structure, when the residual quantity of the connected fasteners A is sufficient, that is, when the connected fasteners A are hard to incline obliquely within the magazine 12, the driver 21 is caused to wait at the upwardly existing first wait position, thereby reducing the response time. And, when the residual quantity of the connected fasteners A has decreased, that is, when the connected fasteners A are easy to incline obliquely within the magazine 12, the driver 21 is caused to wait at the downwardly existing second wait position, thereby preventing the connected fasteners A from inclining.

The drive mechanism control portion 110, before the residual quantity detecting portion 44 detects the decreased residual quantity of the connected fasteners A, may allow the driver 21 to wait at the first wait position where the leading end of the driver 21 exists upwardly of the vertical-direction middle position of the connected fasteners loaded in the magazine 12. After the portion 44 detects the decreased residual quantity, the control portion 110 may allow the driver 21 to wait at the second wait position where the leading end of the driver 21 exists downwardly of the vertical-direction middle position of the connected fasteners loaded in the magazine 12.

In this structure, enhancement in the response property for the sufficient residual quantity of the connected fasteners and prevention of the inclination of the fasteners for the decreased residual quantity of the connected fasteners can be attained positively.

When compared with a driving tool always employing the first wait position and a driving tool always employing the second wait position, the embodiment can provide the following effects.

Figure 11:
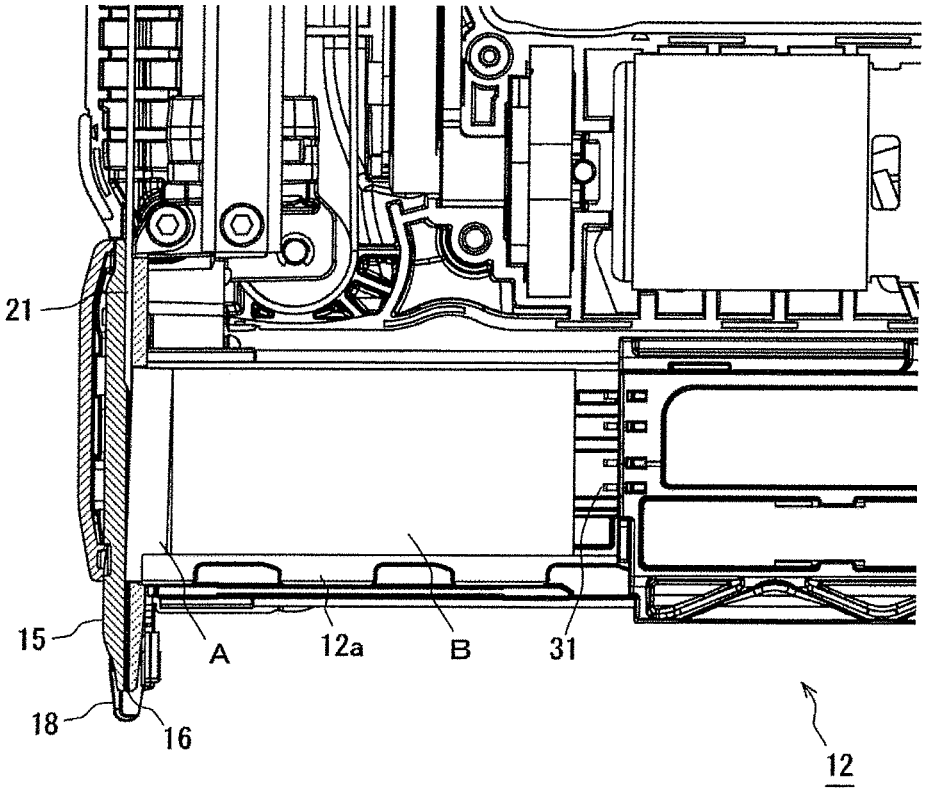
FIG. 11 is a partially enlarged section view of a conventional electric driving tool, showing a state where, with connected fasteners inclined, new connected fasteners are added.

That is, in the case of the driving tool always employing the first wait position, when the residual quantity of the connected fasteners A loaded in the magazine 12 has decreased, the connected fasteners A can tend to incline obliquely within the magazine 12. As shown in FIG. 11, when additional connected fasteners B are mounted onto the magazine 12 while the connected fasteners A are inclined obliquely within the magazine 12, there arises a problem that the head portions of the obliquely inclined connected fasteners A and those of the additional connected fasteners B are superimposed on each other, thereby failing to close a storing portion for storing the fasteners A, B.

Figure 12:
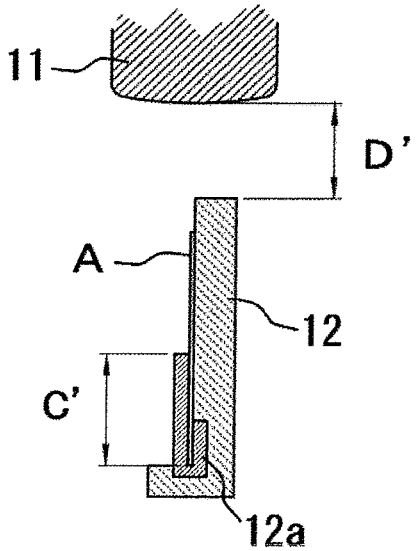
FIG. 12 is an explanatory view of the conventional electric driving tool, showing a state where the guide margin of a guide member is increased in order to prevent the connected fasteners from inclining obliquely.

To solve this problem, the guide margin C' of the guide member 12*a* to be fixed to the lower portion of the magazine 12 must be increased in order to prevent the connected fasteners A with the residual quantity thereof decreased from inclining obliquely (see FIG. 12). However, in the case of the increased guide margin C', it is necessary to increase a clearance D' between the magazine 12 and housing 11 for mounting the connected fasteners A into the guide groove 12*b* or removing them therefrom. That is, when mounting the connected fasteners A onto the guide member 12*a* or removing them therefrom, the connected fasteners A must be moved in the axial direction more greatly at least than the guide margin C', which makes it necessary to increase the clearance D' for moving the fasteners A in the axial direction. When the clearance D' between the magazine 12 and housing 11 is increased, an extra space is necessary, which results in the increased size and weight of the driving tool.

Figure 10A:
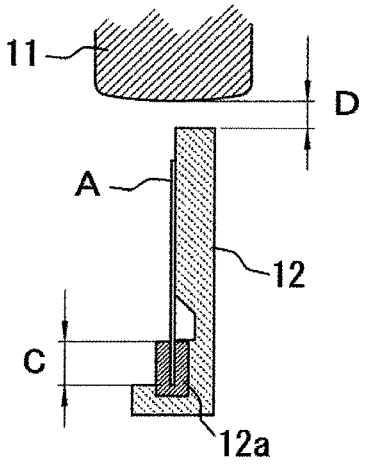
FIGS. 10A and 10B are explanatory views, showing how to mount connected fasteners onto a guide member according to the embodiment.
Figure 10B:
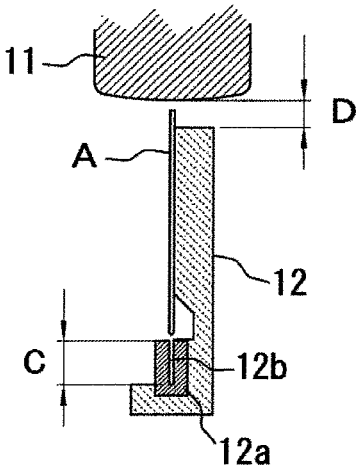

However, in the electric driving tool 10 of the embodiment, when the residual quantity of the connected fasteners A loaded in the magazine 12 has decreased, since the driver 21 waits near the bottom dead center position, the leading one of the connected fasteners A is supported by the driver 21 almost over the whole length thereof, whereby the connected fasteners A are prevented from inclining obliquely within the magazine 12. Therefore, as shown in FIGS. 10A and 10B, the guide margin C of the guide member 12*a* need not be increased. When the guide margin C can be reduced, the clearance D between the magazine 12 and housing 11 for mounting the connected fasteners A into the guide groove 12*b* can be reduced, thereby being able to reduce the size and weight of the driving tool.

Also, in the case of the driving tool always employing the second wait position, the time necessary from the injection operation to the actual injection of the fastener is long, which worsens the response property of the driving tool.

However, in the electric driving tool 10 of the embodiment, since the driver 21 waits near the top dead center position until the residual quantity of the connected fasteners A loaded in the magazine 12 decreases, the deterioration of the response property can be minimized.

In the above embodiment, by operating the trigger 14, the drive mechanism 170 is operated to control the driver 21 to move to a given position and wait there. However, using the contact arm 18 or other operation mechanism such as a switch, the driver 21 may also be controlled to move to a given position and wait there.

In the embodiment, the elastic spring 23 is used as the energizing mechanism. However, there may also be used other energizing device such as an air spring and an oil pressure spring which can energize the plunger downwardly.

DESCRIPTION OF REFERENCE NUMERALS AND SIGNS

10: Electric driving tool
11: Housing
12: Magazine
12*a*: Guide member
12*b*: Guide groove
13: Grip
14: Trigger
15: Nose portion
16: Injection port

17: Motor
18: Contact arm
21: Driver
22: Plunger
23: Spring
31: Pusher
31*a*: Contact piece
41: Top dead center detecting portion
42: Contact detecting portion
43: Trigger detecting portion
44: Residual quantity detecting portion
44*a*: Oscillatory member
44*b*: Oscillation shaft
44*c*: Button
100: Control unit
110: Drive mechanism control portion
A: Connected fasteners
B: Additional connected fasteners
S1: Distance from driver leading end to fastener head at first wait position
S2: Distance from driver leading end to fastener head at second wait position
C: Guide margin
D: Clearance between magazine and housing
C': Conventional guide margin
D': Conventional clearance between magazine and housing

What is claimed is:

1. An electric driving tool comprising:

a plunger normally energized downward by an energizing mechanism;

a driver fixed to the plunger;

a drive mechanism configured to push up and thereafter release the plunger so as to drive the driver using an energizing force of the energizing mechanism;

an operation mechanism configured to operate the drive mechanism;

a magazine in which connected fasteners are loaded;

a pusher configured to sequentially supply leading ones of the connected fasteners in the magazine to a nose portion;

a residual quantity detecting portion configured to detect a decrease of a residual quantity of the connected fasteners in the magazine; and a drive mechanism control portion configured to control an operation of the drive mechanism, wherein the drive mechanism control portion is configured to control the drive mechanism such that the plunger is pushed up to a top dead center position from a wait position and is released to drive the driver down to a bottom dead center position by the energizing force of the energizing mechanism, in accordance with an operation of the operation mechanism, wherein the driver, having driven out the fastener, moves upwardly from the bottom dead center position so as to stop at the wait position, and wherein, in a condition that the residual quantity detecting portion detects the decrease of the residual quantity of the connected fasteners, the drive mechanism control portion is configured to set the wait position of the driver to be lower than a wait position of the driver in a condition before the residual quantity detecting portion detects the decrease of the residual quantity of the connected fasteners.

2. The electric driving tool according to claim 1, wherein the drive mechanism control portion controls the drive mechanism such that:

the driver waits at a first wait position where the driver waits near the top dead center position and where a leading end of the driver exists upwardly of a middle position of the connected fasteners in a vertical direction in the condition before the residual quantity detecting portion detects the decrease of the residual quantity of the connected fasteners; and the driver waits at a second wait position where the driver waits near the bottom dead center position and where the leading end of the driver exists downwardly of said middle position of the connected fasteners in the condition after the residual quantity detecting portion detects the decrease of the residual quantity of the connected fasteners.

3. The electric driving tool according to claim 2, wherein the first wait position is a wait position in which a distance from the leading end of the driver to a head of the connected fasteners is less than or equal to ¼ of a whole length of the connected fasteners.

4. The electric driving tool according to claim 2, wherein the second wait position is a wait position in which a distance from the leading end of the driver to a head of the connected fasteners is greater than or equal to ¾ of a whole length of the connected fasteners.

5. The electric driving tool according to claim 2, wherein the first wait position is a wait position in which a distance from the leading end of the driver to a head of the connected fasteners is less than or equal to ¼ of a whole length of the connected fasteners; and the second wait position is a wait position in which a distance from the leading end of the driver to a head of the connected fasteners is greater than or equal to ¾ of a whole length of the connected fasteners.

6. The electric driving tool according to claim 1, wherein the residual quantity detecting portion is configured to detect a decrease of a residual quantity of the connected fasteners in the magazine to a non-zero value; and the drive mechanism control portion is configured to set the wait position of the driver in a condition that the residual quantity detecting portion detects the decrease of the residual quantity of the connected fasteners to a non-zero value to be lower than a wait position of the driver in a condition before the residual quantity detecting portion detects the decrease of the residual quantity of the connected fasteners to a non-zero value.

* * * * *